US008684094B2

(12) United States Patent
Greci

(10) Patent No.: US 8,684,094 B2
(45) Date of Patent: Apr. 1, 2014

(54) PREVENTING FLOW OF UNDESIRED FLUID THROUGH A VARIABLE FLOW RESISTANCE SYSTEM IN A WELL

(71) Applicant: Halliburton Energy Services, Inc., Houston, TX (US)

(72) Inventor: Stephen M. Greci, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/659,435

(22) Filed: Oct. 24, 2012

(65) Prior Publication Data

US 2013/0118729 A1 May 16, 2013

(51) Int. Cl.
*E21B 29/00* (2006.01)

(52) U.S. Cl.
USPC ..... 166/376; 137/68.11

(58) Field of Classification Search
USPC ..... 166/117, 332.8, 376; 137/67, 68.11, 137/813, 812, 806
See application file for complete search history.

(56) References Cited

U.S. PATENT DOCUMENTS

| | | | |
|---|---|---|---|
| 2,324,819 | A | 6/1941 | Butzbach |
| 3,091,393 | A | 5/1963 | Sparrow |
| 3,216,439 | A | 11/1965 | Manion |
| 3,233,621 | A | 2/1966 | Manion |
| 3,256,899 | A | 6/1966 | Dexter et al. |
| 3,282,279 | A | 11/1966 | Manion |
| 3,461,897 | A | 8/1969 | Kwok |
| 3,470,894 | A | 10/1969 | Rimmer |
| 3,474,670 | A | 10/1969 | Rupert |
| 3,489,009 | A | 1/1970 | Rimmer |
| 3,515,160 | A | 6/1970 | Cohen |
| 3,529,614 | A | 9/1970 | Nelson |
| 3,537,466 | A | 11/1970 | Chapin |
| 3,566,900 | A | 3/1971 | Black |
| 3,586,104 | A | 6/1971 | Hyde |
| 3,598,137 | A | 8/1971 | Glaze |
| 3,620,238 | A | 11/1971 | Kawabata |
| 3,670,753 | A | 6/1972 | Healey |
| 3,704,832 | A | 12/1972 | Fix et al. |

(Continued)

FOREIGN PATENT DOCUMENTS

| | | | |
|---|---|---|---|
| EP | 0834342 | A2 | 4/1998 |
| EP | 1857633 | A2 | 11/2007 |

(Continued)

OTHER PUBLICATIONS

Joseph M. Kirchner, "Fluid Amplifiers", 1996, 6 pages, McGraw-Hill, New York.

(Continued)

*Primary Examiner* — Shane Bomar
*Assistant Examiner* — Kipp Wallace
(74) *Attorney, Agent, or Firm* — Smith IP Services, P.C.

(57) ABSTRACT

A flow control system for use with a subterranean well can include a flow chamber through which a fluid composition flows, and a closure device which is biased toward a closed position in which the closure device prevents flow through the flow chamber. The closure device can be displaced to the closed position in response to an increase in a ratio of undesired fluid to desired fluid in the fluid composition. A structure can prevent the closure device from being displaced to the closed position. The fluid composition can flow through the structure to an outlet of the flow chamber.

17 Claims, 7 Drawing Sheets

(56) References Cited

U.S. PATENT DOCUMENTS

| | | | |
|---|---|---|---|
| 3,712,321 | A | 1/1973 | Bauer |
| 3,717,164 | A | 2/1973 | Griffin |
| 3,776,460 | A | 12/1973 | Fichter |
| 3,885,627 | A | 5/1975 | Berry et al. |
| 3,942,557 | A | 3/1976 | Tsuchiya |
| 4,029,127 | A | 6/1977 | Thompson |
| 4,082,169 | A | 4/1978 | Bowles |
| 4,127,173 | A | 11/1978 | Watkins et al. |
| 4,187,909 | A | 2/1980 | Erbstoesser |
| 4,276,943 | A | 7/1981 | Holmes |
| 4,286,627 | A | 9/1981 | Graf |
| 4,291,395 | A | 9/1981 | Holmes |
| 4,307,653 | A | 12/1981 | Goes et al. |
| 4,323,991 | A | 4/1982 | Holmes et al. |
| 4,385,875 | A | 5/1983 | Kanazawa |
| 4,390,062 | A | 6/1983 | Fox |
| 4,418,721 | A | 12/1983 | Holmes |
| 4,557,295 | A | 12/1985 | Holmes |
| 4,895,582 | A | 1/1990 | Bielefeldt |
| 4,919,204 | A | 4/1990 | Baker et al. |
| 5,184,678 | A | 2/1993 | Pechkov et al. |
| 5,303,782 | A | 4/1994 | Johannessen |
| 5,455,804 | A | 10/1995 | Holmes et al. |
| 5,482,117 | A | 1/1996 | Kolpak et al. |
| 5,484,016 | A | 1/1996 | Surjaatmadja et al. |
| 5,505,262 | A | 4/1996 | Cobb |
| 5,533,571 | A | 7/1996 | Surjaatmadja et al. |
| 5,570,744 | A | 11/1996 | Weingarten et al. |
| 5,893,383 | A | 4/1999 | Facteau |
| 6,015,011 | A | 1/2000 | Hunter |
| 6,078,471 | A | 6/2000 | Fiske |
| 6,109,372 | A | 8/2000 | Dorel et al. |
| 6,112,817 | A | 9/2000 | Voll et al. |
| 6,241,019 | B1 | 6/2001 | Davidson et al. |
| 6,336,502 | B1 | 1/2002 | Surjaatmadja et al. |
| 6,345,963 | B1 | 2/2002 | Thomin et al. |
| 6,367,547 | B1 | 4/2002 | Towers et al. |
| 6,371,210 | B1 | 4/2002 | Bode et al. |
| 6,405,797 | B2 | 6/2002 | Davidson et al. |
| 6,497,252 | B1 | 12/2002 | Kholer et al. |
| 6,619,394 | B2 | 9/2003 | Soliman et al. |
| 6,622,794 | B2 | 9/2003 | Zisk, Jr. |
| 6,627,081 | B1 | 9/2003 | Hilditch et al. |
| 6,644,412 | B2 | 11/2003 | Bode et al. |
| 6,691,781 | B2 | 2/2004 | Grant et al. |
| 6,719,048 | B1 | 4/2004 | Ramos et al. |
| 6,851,473 | B2 | 2/2005 | Davidson |
| 6,913,079 | B2 | 7/2005 | Tubel |
| 6,976,507 | B1 | 12/2005 | Webb et al. |
| 7,025,134 | B2 | 4/2006 | Byrd et al. |
| 7,114,560 | B2 | 10/2006 | Nguyen et al. |
| 7,185,706 | B2 | 3/2007 | Freyer |
| 7,213,650 | B2 | 5/2007 | Lehman et al. |
| 7,213,681 | B2 | 5/2007 | Birchak et al. |
| 7,216,738 | B2 | 5/2007 | Birchak et al. |
| 7,290,606 | B2 | 11/2007 | Coronado et al. |
| 7,318,471 | B2 | 1/2008 | Rodney et al. |
| 7,404,416 | B2 | 7/2008 | Schultz et al. |
| 7,405,998 | B2 | 7/2008 | Webb et al. |
| 7,409,999 | B2 | 8/2008 | Henriksen et al. |
| 7,413,010 | B2 | 8/2008 | Blauch et al. |
| 7,537,056 | B2 | 5/2009 | MacDougall |
| 7,578,343 | B2 | 8/2009 | Augustine |
| 7,621,336 | B2 | 11/2009 | Badalamenti et al. |
| 7,828,067 | B2 | 11/2010 | Scott et al. |
| 7,857,050 | B2 | 12/2010 | Zazovsky et al. |
| 8,127,856 | B1 | 3/2012 | Nish et al. |
| 8,235,128 | B2 | 8/2012 | Dykstra et al. |
| 8,302,696 | B2 | 11/2012 | Williams et al. |
| 8,327,885 | B2 | 12/2012 | Dykstra et al. |
| 8,387,662 | B2 | 3/2013 | Dykstra et al. |
| 2006/0131033 | A1 | 6/2006 | Bode et al. |
| 2007/0028977 | A1 | 2/2007 | Goulet |
| 2007/0045038 | A1 | 3/2007 | Han et al. |
| 2007/0246407 | A1 | 10/2007 | Richards et al. |
| 2007/0256828 | A1 | 11/2007 | Birchak et al. |
| 2008/0041580 | A1 | 2/2008 | Freyer et al. |
| 2008/0041581 | A1 | 2/2008 | Richards |
| 2008/0041582 | A1 | 2/2008 | Saetre et al. |
| 2008/0041588 | A1 | 2/2008 | Richards et al. |
| 2008/0149323 | A1 | 6/2008 | O'Malley et al. |
| 2008/0169099 | A1 | 7/2008 | Pensgaard |
| 2008/0283238 | A1 | 11/2008 | Richards et al. |
| 2008/0314590 | A1 | 12/2008 | Patel |
| 2009/0000787 | A1 | 1/2009 | Hill et al. |
| 2009/0008088 | A1 | 1/2009 | Schultz et al. |
| 2009/0008090 | A1 | 1/2009 | Schultz et al. |
| 2009/0009297 | A1 | 1/2009 | Shinohara et al. |
| 2009/0009333 | A1 | 1/2009 | Bhogal et al. |
| 2009/0009336 | A1 | 1/2009 | Ishikawa |
| 2009/0009412 | A1 | 1/2009 | Warther |
| 2009/0009437 | A1 | 1/2009 | Hwang et al. |
| 2009/0009445 | A1 | 1/2009 | Lee |
| 2009/0009447 | A1 | 1/2009 | Naka et al. |
| 2009/0065197 | A1 | 3/2009 | Eslinger |
| 2009/0078427 | A1 | 3/2009 | Patel |
| 2009/0078428 | A1 | 3/2009 | Ali |
| 2009/0101352 | A1* | 4/2009 | Coronado et al. ..... 166/373 |
| 2009/0101354 | A1 | 4/2009 | Holmes et al. |
| 2009/0120647 | A1 | 5/2009 | Turick et al. |
| 2009/0133869 | A1 | 5/2009 | Clem |
| 2009/0151925 | A1 | 6/2009 | Richards et al. |
| 2009/0159282 | A1 | 6/2009 | Webb et al. |
| 2009/0250224 | A1 | 10/2009 | Wright et al. |
| 2009/0277639 | A1 | 11/2009 | Schultz et al. |
| 2009/0277650 | A1 | 11/2009 | Casciaro et al. |
| 2011/0042091 | A1 | 2/2011 | Dykstra et al. |
| 2011/0042092 | A1 | 2/2011 | Fripp et al. |
| 2011/0079384 | A1 | 4/2011 | Russell et al. |
| 2011/0094732 | A1 | 4/2011 | Lehman et al. |
| 2011/0186300 | A1 | 8/2011 | Dykstra et al. |
| 2011/0198097 | A1 | 8/2011 | Moen |
| 2011/0214876 | A1 | 9/2011 | Dykstra et al. |
| 2011/0297384 | A1 | 12/2011 | Fripp et al. |
| 2011/0297385 | A1 | 12/2011 | Dykstra et al. |
| 2012/0048563 | A1 | 3/2012 | Holderman |
| 2012/0060624 | A1 | 3/2012 | Dykstra |
| 2012/0061088 | A1 | 3/2012 | Dykstra et al. |
| 2012/0111577 | A1 | 5/2012 | Dykstra et al. |
| 2012/0125120 | A1 | 5/2012 | Dykstra |
| 2012/0125626 | A1* | 5/2012 | Constantine ..... 166/373 |
| 2012/0138304 | A1 | 6/2012 | Dykstra et al. |
| 2012/0152527 | A1 | 6/2012 | Dykstra et al. |
| 2012/0181037 | A1 | 7/2012 | Holderman |
| 2012/0255351 | A1 | 10/2012 | Dykstra |
| 2012/0255739 | A1 | 10/2012 | Fripp et al. |
| 2012/0305243 | A1* | 12/2012 | Hallundbæk et al. ..... 166/255.1 |
| 2013/0020088 | A1* | 1/2013 | Dyer et al. ..... 166/373 |

FOREIGN PATENT DOCUMENTS

| | | | |
|---|---|---|---|
| EP | 2146049 | A2 | 1/2010 |
| WO | 0214647 | A1 | 2/2002 |
| WO | 03062597 | A1 | 7/2003 |
| WO | 2004033063 | A2 | 4/2004 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |
| WO | 2010087719 | A1 | 8/2010 |
| WO | 2011095512 | A2 | 8/2011 |
| WO | 2011115494 | A1 | 9/2011 |
| WO | 2012033638 | A2 | 3/2012 |

OTHER PUBLICATIONS

Joseph M. Kirchner, et al., "Design Theory of Fluidic Components", 1975, 9 pages, Academic Press, New York.

(56) References Cited

OTHER PUBLICATIONS

Microsoft Corporation, "Fluidics" article, Microsoft Encarta Online Encyclopedia, copyright 1997-2009, 1 page, USA.
The Lee Company Technical Center, "Technical Hydraulic Handbook" 11th Edition, copyright 1971-2009, 7 pages, Connecticut.
Lee Precision Micro Hydraulics, Lee Restrictor Selector product brochure; Jan. 2011, 9 pages.
Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.
Tesar, V.; Sampling by Fluidics and Microfluidics; Acta Polytechnica; Feb. 2002; pp. 41-49; vol. 42; The University of Sheffield; Sheffield, UK.
Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.
International Search Report and Written Opinion issued Mar. 25, 2011 for International Patent Application Serial No. PCT/US2010/044409, 9 pages.
International Search Report and Written Opinion issued Mar. 31, 2011 for International Patent Application Serial No. PCT/US2010/044421, 9 pages.
Office Action issued Jun. 27, 2011, for U.S. Appl. No. 12/791,993, 17 pages.
Office Action issued Dec. 28, 2012 for U.S. Appl. No. 12/881,296, 29 pages.
Office Action issued Jan. 17, 2013 for U.S. Appl. No. 12/879,846, 26 pages.
Office Action issued Jan. 16, 2013 for U.S. Appl. No. 13/495,078, 24 pages.
Office Action issued Jan. 22, 2013 for U.S. Appl. No. 13/633,693, 30 pages.
Search Report issued Aug. 31, 2012 for International Application Serial No. PCT/US11/60606, 6 pages.
Written Opinion issued Aug. 31, 2012 for International Application Serial No. PCT/US11/60606, 4 pages.
Search Report and Written Opinion issued Oct. 19, 2012 for International Application No. PCT/US12/30641, 9 pages.
Office Action issued Aug. 23, 2013 for U.S. Appl. No. 13/084,025, 93 pages.
Office Action issued Feb. 21, 2013 for U.S. Appl. No. 12/792,095, 26 pages.
Office Action issued Nov. 2, 2011 for U.S. Appl. No. 12/792,146, 34 pages.
Office Action issued Nov. 3, 2011 for U.S. Appl. No. 13/111,169, 16 pages.
Office Action issued Nov. 2, 2011 for U.S. Appl. No. 12/792,117, 35 pages.
Office Action issued Oct. 27, 2011 for U.S. Appl. No. 12/791,993, 15 pages.
Office Action issued Oct. 26, 2011 for U.S. Appl. No. 13/111,169, 28 pages.
Stanley W. Angrist; "Fluid Control Devices", Scientific American Magazine, dated Dec. 1964, 8 pages.
Rune Freyer et al.; "An Oil Selective Inflow Control System", Society of Petroleum Engineers Inc. paper, SPE 78272, dated Oct. 29-31, 2002, 8 pages.
Stanley W. Angrist; "Fluid Control Devices", published Dec. 1964, 5 pages.
Office Action issued Mar. 7, 2012 for U.S. Appl. No. 12/792,117, 40 pages.
Office Action issued Mar. 8, 2012 for U.S. Appl. No. 12/792,146, 26 pages.
International Search Report and Written Opinion issued Mar. 27, 2012 for International Patent Application Serial No. PCT/US2012/030641, 9 pages.
Specification and Drawings for U.S. Appl. No. 12/542,695, filed Aug. 18, 2009, 32 pages.
International Search Report with Written Opinion issued Aug. 3, 2012 for PCT Patent Application No. PCT/US11/059530, 15 pages.
International Search Report with Written Opinion issued Aug. 3, 2012 for PCT Patent Application No. PCT/US11/059534, 14 pages.
Office Action issued Jul. 25, 2012 for U.S. Appl. No. 12/881,296, 61 pages.
Advisory Action issued Aug. 30, 2012 for U.S. Appl. No. 13/111,169, 15 pages.
Office Action issued Sep. 10, 2012 for U.S. Appl. No. 12/792,095, 59 pages.
International Search Report with Written Opinion dated Aug. 31, 2012 for PCT Patent Application No. PCT/US11/060606, 10 pages.
Office Action issued Sep. 19, 2012 for U.S. Appl. No. 12/879,846, 78 pages.
Office Action issued Sep. 19, 2012 for U.S. Appl. No. 13/495,078, 29 pages.
Specification and Drawings for U.S. Appl. No. 12/958,625, filed Dec. 2, 2010, 37 pages.
Specification and Drawings for U.S. Appl. No. 12/974,212, filed Dec. 21, 2010, 41 pages.
Office Action issued Oct. 11, 2013 for U.S. Appl. No. 12/792,095, 18 pages.
Office Action issued Nov. 5, 2013 for U.S. Appl. No. 13/084,025, 23 pages.
Office Action issued Apr. 24, 2013 for U.S. Appl. No. 13/633,693, 33 pages.
Office Action issued May 8, 2013 for U.S. Appl. No. 12/792,095, 14 pages.
Apparatus and Method of Inducing Fluidic Oscillation in a Rotating Cleaning Nozzle, ip.com, dated Apr. 24, 2007, 3 pages.
Office Action issued May 29, 2013 for U.S. Appl. No. 12/881,296, 26 pages.
Specification and Drawings for U.S. Appl. No. 13/430,507, filed Mar. 26, 2012, 28 pages.
International Search Report with Written Opinion issued Mar. 26, 2012 for PCT Patent Application No. PCT/US11/048986, 9 pages.
International Search Report with Written Opinion issued Apr. 17, 2012 for PCT Patent Application No. PCT/US11/050255, 9 pages.
Office Action issued May 24, 2012 for U.S. Appl. No. 12/869,836, 60 pages.
Office Action issued May 24, 2012 for U.S. Appl. No. 13/430,507, 17 pages.
International Search Report with Written Opinion issued Jan. 5, 2012 for PCT Patent Application No. PCT/US2011/047925, 9 pages.
Office Action issued Jun. 19, 2012 for U.S. Appl. No. 13/111,169, 17 pages.

* cited by examiner

PREVENTING FLOW OF UNDESIRED FLUID THROUGH A VARIABLE FLOW RESISTANCE SYSTEM IN A WELL

CROSS-REFERENCE TO RELATED APPLICATION

This application claims the benefit under 35 USC §119 of the filing date of International Application Serial No. PCT/US11/60606, filed 14 Nov. 2011. The entire disclosure of this prior application is incorporated herein by this reference.

BACKGROUND

This disclosure relates generally to equipment utilized and operations performed in conjunction with a subterranean well and, in an example described below, more particularly provides for preventing flow of undesired fluid through a variable flow resistance system.

In a hydrocarbon production well, it is many times beneficial to be able to regulate flow of fluids from an earth formation into a wellbore. A variety of purposes may be served by such regulation, including prevention of water or gas coning, minimizing sand production, minimizing water and/or gas production, maximizing oil and/or gas production, balancing production among zones, etc.

In an injection well, it is typically desirable to evenly inject water, steam, gas, etc., into multiple zones, so that hydrocarbons are displaced evenly through an earth formation, without the injected fluid prematurely breaking through to a production wellbore. Thus, the ability to regulate flow of fluids from a wellbore into an earth formation can also be beneficial for injection wells.

Therefore, it will be appreciated that advancements in the art of controlling fluid flow in a well would be desirable in the circumstances mentioned above, and such advancements would also be beneficial in a wide variety of other circumstances.

SUMMARY

In the disclosure below, a flow control system is provided which brings improvements to the art of regulating fluid flow in wells. One example is described below in which a flow control system is used in conjunction with a variable flow resistance system. Another example is described in which flow through the variable flow resistance system is completely prevented when an unacceptable level of undesired fluid is flowed through the system.

In one aspect, a flow control system for use with a subterranean well can include a flow chamber through which a fluid composition flows, and a closure device which is biased toward a closed position in which the closure device prevents flow through the flow chamber. The closure device can be displaced to the closed position in response to an increase in a ratio of undesired fluid to desired fluid in the fluid composition.

In another aspect, a flow control system can include a closure device and a structure which prevents the closure device from being displaced to a closed position in which the closure device prevents flow through the flow chamber. The fluid composition can flow through the structure to an outlet of the flow chamber.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
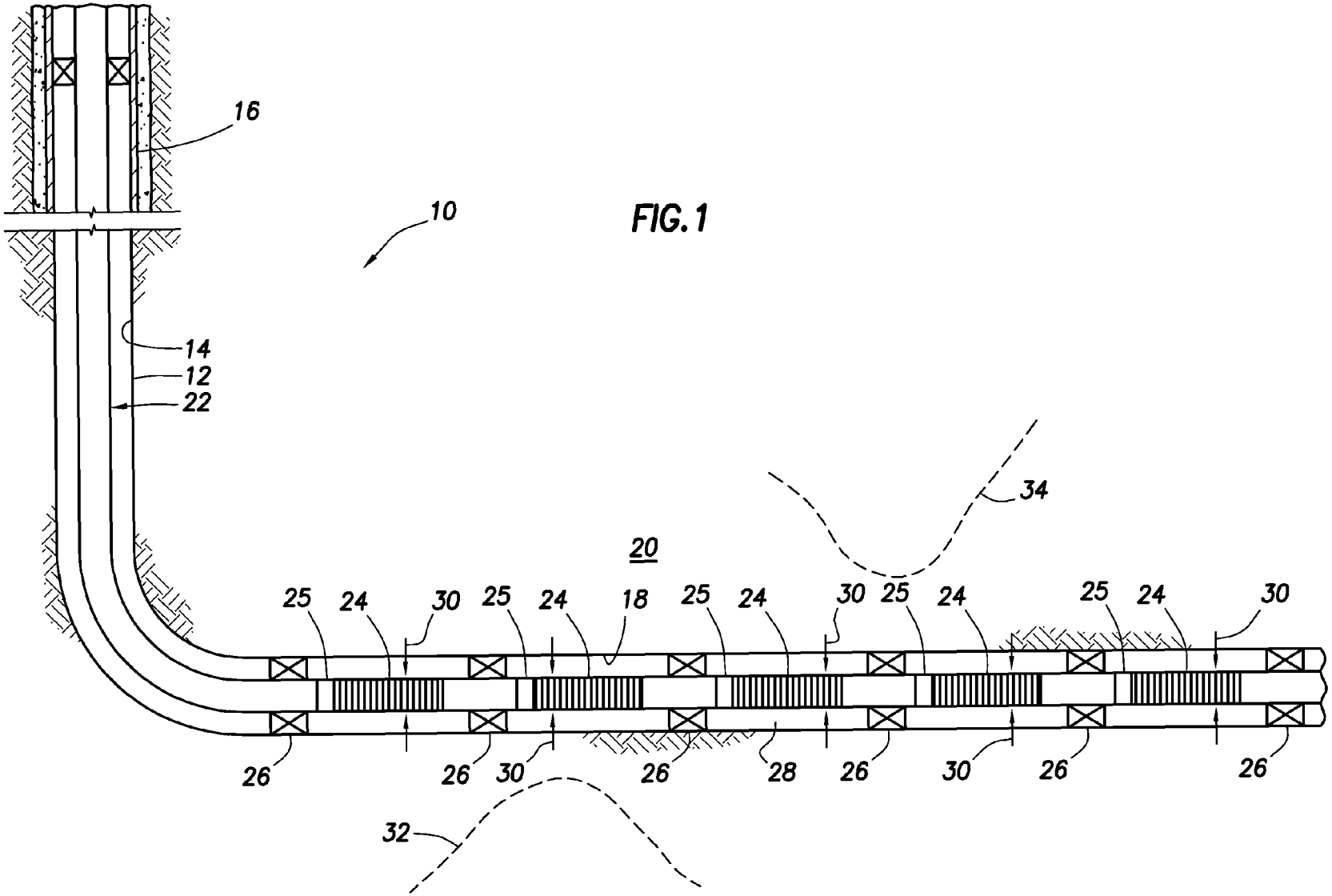
FIG. 1 is a representative partially cross-sectional view of a well system which can embody principles of this disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow resistance systems 25 described more fully below can provide these benefits by increasing resistance to flow if a fluid velocity increases beyond a selected level (e.g., to thereby balance flow among zones, prevent water or gas coning, etc.), and/or increasing resistance to flow if a fluid viscosity decreases below a selected level (e.g., to thereby restrict flow of an undesired fluid, such as water or gas, in an oil producing well).

As used herein, the term "viscosity" is used to indicate any of the rheological properties including kinematic viscosity, yield strength, visco-plasticity, surface tension, wettability, etc.

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. If it is desired to produce gas from a well, but not to produce water or oil, the gas is a desired fluid, and water and oil are undesired fluids. If it is desired to inject steam into a formation, but not to inject water, then steam is a desired fluid and water is an undesired fluid.

Note that, at downhole temperatures and pressures, hydrocarbon gas can actually be completely or partially in liquid phase. Thus, it should be understood that when the term "gas" is used herein, supercritical, liquid, condensate and/or gaseous phases are included within the scope of that term.

Figure 2:
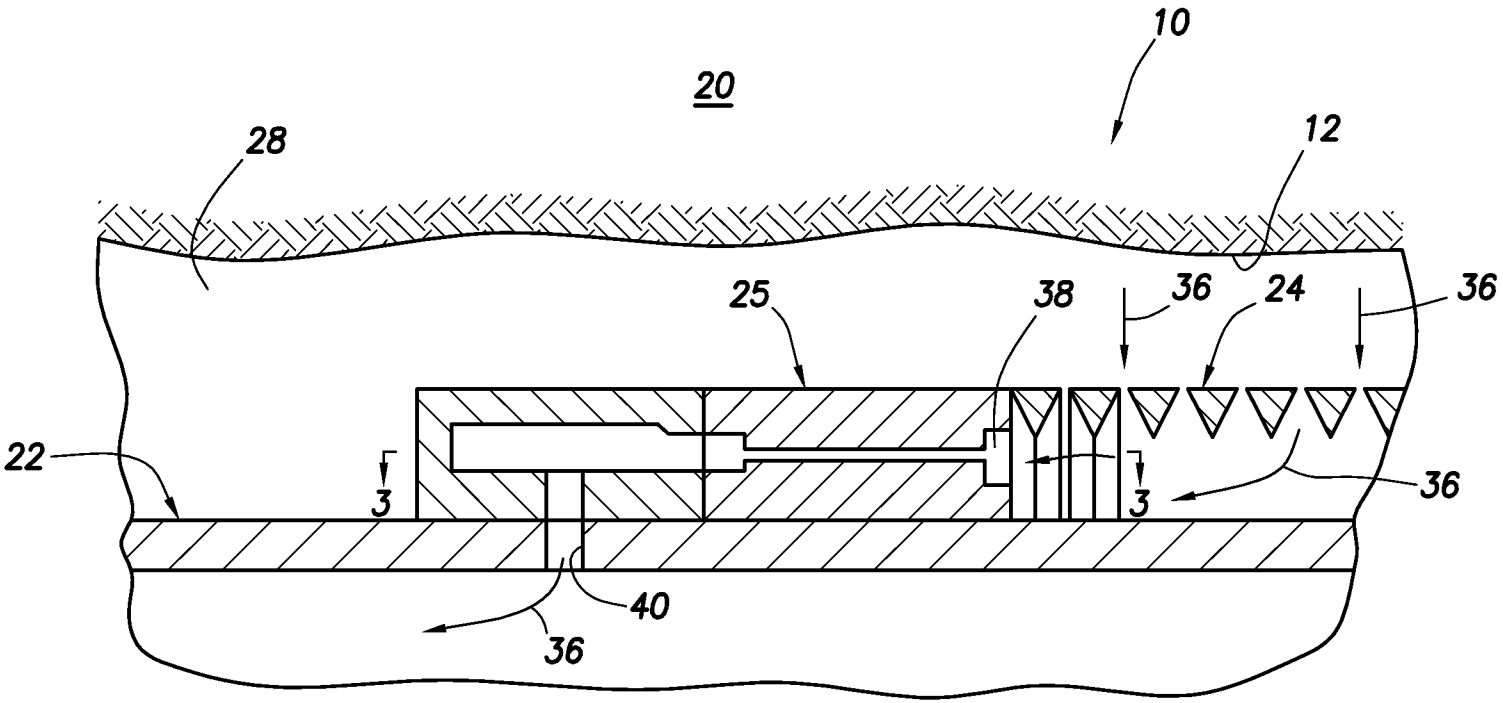
FIG. 2 is an enlarged scale representative cross-sectional view of a well screen and a variable flow resistance system which may be used in the well system of FIG. 1.

Referring additionally now to FIG. 2, an enlarged scale cross-sectional view of one of the variable flow resistance systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the variable flow resistance system 25.

A fluid composition can include one or more undesired or desired fluids. Both steam and water can be combined in a fluid composition. As another example, oil, water and/or gas can be combined in a fluid composition.

Flow of the fluid composition 36 through the variable flow resistance system 25 is resisted based on one or more characteristics (such as viscosity, velocity, etc.) of the fluid composition. The fluid composition 36 is then discharged from the variable flow resistance system 25 to an interior of the tubular string 22 via an outlet 40.

In other examples, the well screen 24 may not be used in conjunction with the variable flow resistance system 25 (e.g., in injection operations), the fluid composition 36 could flow in an opposite direction through the various elements of the well system 10 (e.g., in injection operations), a single variable flow resistance system could be used in conjunction with multiple well screens, multiple variable flow resistance systems could be used with one or more well screens, the fluid composition could be received from or discharged into regions of a well other than an annulus or a tubular string, the fluid composition could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The variable flow resistance system 25 is depicted in simplified form in FIG. 2, but in a preferred example the system can include various passages and devices for performing various functions, as described more fully below. In addition, the system 25 preferably at least partially extends circumferentially about the tubular string 22, and/or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3B:
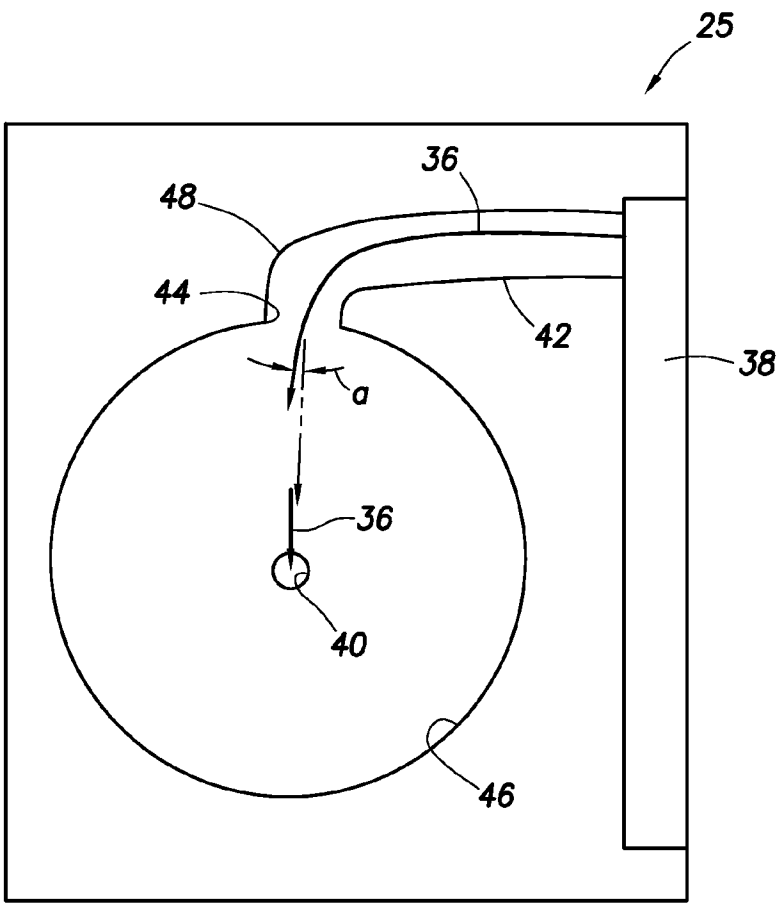
FIGS. 3A & B are representative "unrolled" plan views of one configuration of the variable flow resistance system, taken along line 3-3 of FIG. 2.
Figure 3A:
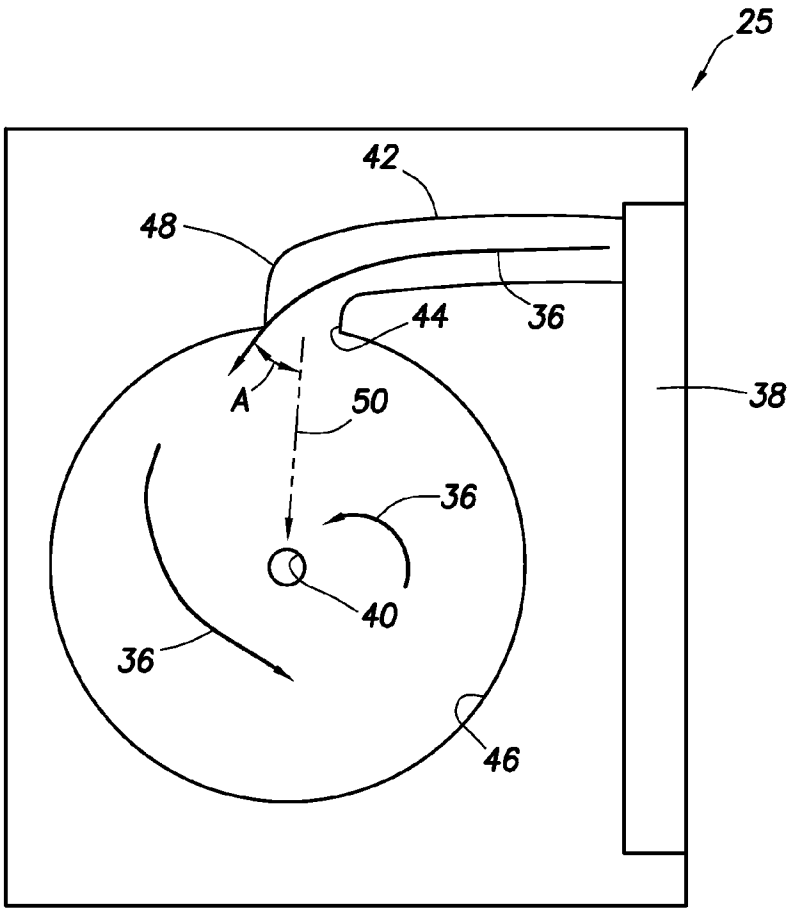

Referring additionally now to FIGS. 3A & B, a more detailed cross-sectional view of one example of the system 25 is representatively illustrated. The system 25 is depicted in FIGS. 3A & B as if it is "unrolled" from its circumferentially extending configuration to a generally planar configuration.

As described above, the fluid composition 36 enters the system 25 via the inlet 38, and exits the system via the outlet 40. A resistance to flow of the fluid composition 36 through the system 25 varies based on one or more characteristics of the fluid composition.

In FIG. 3A, a relatively high velocity and/or low viscosity fluid composition 36 flows through a flow passage 42 from the system inlet 38 to an inlet 44 of a flow chamber 46. The flow passage 42 has an abrupt change in direction 48 just upstream of the inlet 44. The abrupt change in direction 48 is illustrated as a relatively small radius ninety degree curve in the flow passage 42, but other types of direction changes may be used, if desired.

As depicted in FIG. 3A, the chamber 46 is generally cylindrical-shaped and, prior to the abrupt change in direction 48, the flow passage 42 directs the fluid composition 36 to flow generally tangentially relative to the chamber. Because of the relatively high velocity and/or low viscosity of the fluid composition 36, it does not closely follow the abrupt change in direction 48, but instead continues into the chamber 46 via the inlet 44 in a direction which is substantially angled (see angle A in FIG. 3A) relative to a straight direction 50 from the inlet 44 to the outlet 40. The fluid composition 36 will, thus, flow circuitously from the inlet 44 to the outlet 40, eventually spiraling inward to the outlet.

In contrast, a relatively low velocity and/or high viscosity fluid composition 36 flows through the flow passage 42 to the chamber inlet 44 in FIG. 3B. Note that the fluid composition 36 in this example more closely follows the abrupt change in direction 48 of the flow passage 42 and, therefore, flows through the inlet 44 into the chamber 46 in a direction which is only slightly angled (see angle a in FIG. 3B) relative to the straight direction 50 from the inlet 44 to the outlet 40. The fluid composition 36 in this example will, thus, flow much more directly from the inlet 44 to the outlet 40.

Note that, as depicted in FIG. 3B, the fluid composition 36 also exits the chamber 46 via the outlet 40 in a direction which is only slightly angled relative to the straight direction 50 from the inlet 44 to the outlet 40. Thus, the fluid composition 36 exits the chamber 46 in a direction which changes based on velocity, viscosity, and/or the ratio of desired fluid to undesired fluid in the fluid composition.

It will be appreciated that the much more circuitous flow path taken by the fluid composition 36 in the example of FIG. 3A dissipates more of the fluid composition's energy at the same flow rate and, thus, results in more resistance to flow, as compared to the much more direct flow path taken by the fluid composition in the example of FIG. 3B. If oil is a desired fluid, and water and/or gas are undesired fluids, then it will be appreciated that the variable flow resistance system 25 of FIGS. 3A & B will provide less resistance to flow of the fluid composition 36 when it has an increased ratio of desired to undesired fluid therein, and will provide greater resistance to flow when the fluid composition has a decreased ratio of desired to undesired fluid therein.

Since the chamber 46 has a generally cylindrical shape as depicted in the examples of FIGS. 3A & B, the straight direction 50 from the inlet 44 to the outlet 40 is in a radial direction. The flow passage 42 upstream of the abrupt change in direction 48 is directed generally tangential relative to the chamber 46 (i.e., perpendicular to a line extending radially from the center of the chamber). However, the chamber 46 is not necessarily cylindrical-shaped and the straight direction 50 from the inlet 44 to the outlet 40 is not necessarily in a radial direction, in keeping with the principles of this disclosure.

Since the chamber 46 in this example has a cylindrical shape with a central outlet 40, and the fluid composition 36 (at least in FIG. 3A) spirals about the chamber, increasing in velocity as it nears the outlet, driven by a pressure differential from the inlet 44 to the outlet, the chamber may be referred to as a "vortex" chamber.

Figure 4B:
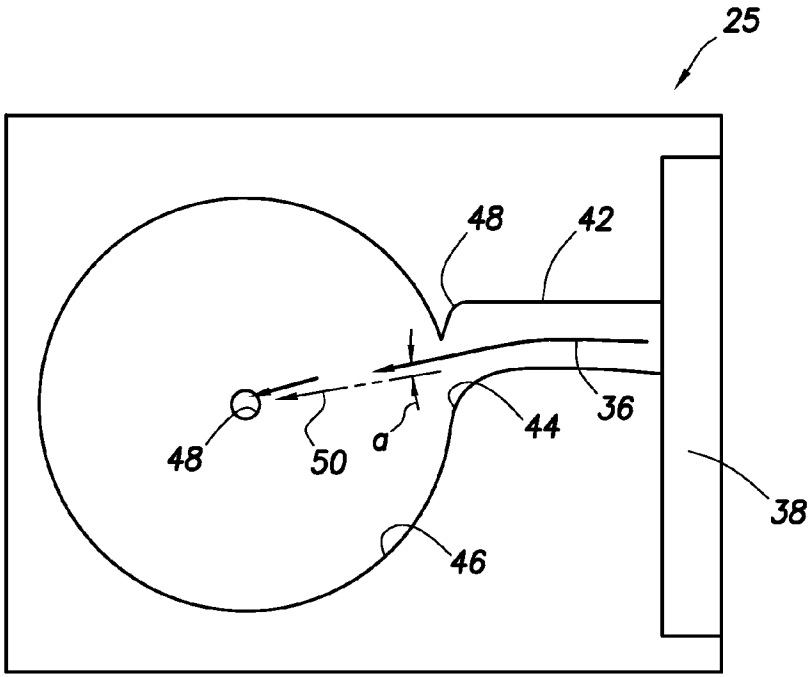
FIGS. 4A & B are representative plan views of another configuration of the variable flow resistance system.
Figure 4A:
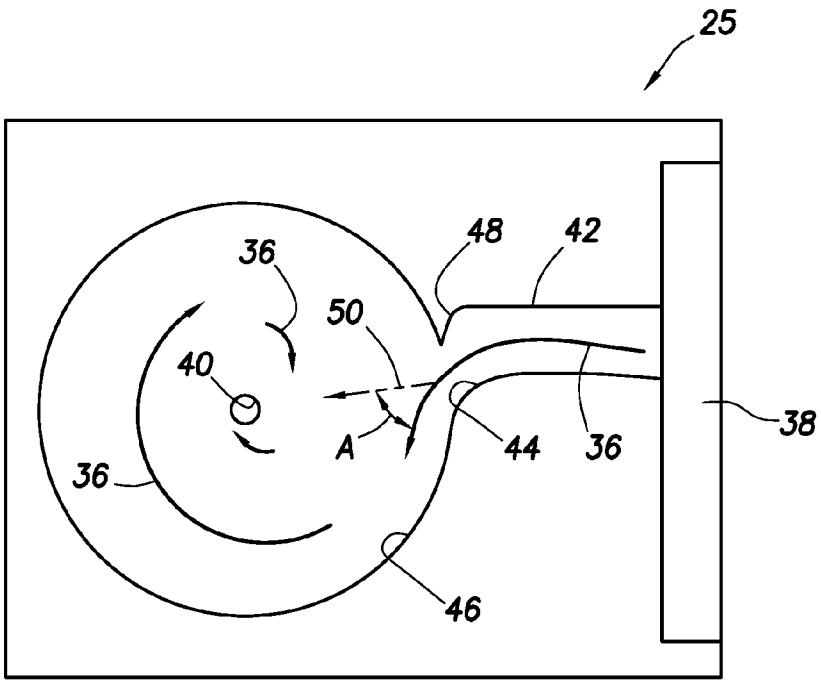

Referring additionally now to FIGS. 4A & B, another configuration of the variable flow resistance system 25 is representatively illustrated. The configuration of FIGS. 4A & B is similar in many respects to the configuration of FIGS. 3A & B, but differs at least in that the flow passage 42 extends much more in a radial direction relative to the chamber 46 upstream of the abrupt change in direction 48, and the abrupt change in direction influences the fluid composition 36 to flow away from the straight direction 50 from the inlet 44 to the outlet 40.

In FIG. 4A, a relatively high viscosity and/or low velocity fluid composition 36 is influenced by the abrupt change in direction 48 to flow into the chamber 46 in a direction away from the straight direction 50 (e.g., at a relatively large angle A to the straight direction). Thus, the fluid composition 36 will flow circuitously about the chamber 46 prior to exiting via the outlet 40.

Note that this is the opposite of the situation described above for FIG. 3B, in which the relatively high viscosity and/or low velocity fluid composition 36 enters the chamber 46 via the inlet 44 in a direction which is only slightly angled relative to the straight direction 50 from the inlet to the outlet 40. However, a similarity of the FIGS. 3B & 4A configurations is that the fluid composition 36 tends to change direction with the abrupt change in direction 48 in the flow passage 42.

In contrast, a relatively high velocity and/or low viscosity fluid composition 36 flows through the flow passage 42 to the chamber inlet 44 in FIG. 4B. Note that the fluid composition 36 in this example does not closely follow the abrupt change in direction 48 of the flow passage 42 and, therefore, flows through the inlet 44 into the chamber 46 in a direction which is angled only slightly relative to the straight direction 50 from the inlet 44 to the outlet 40. The fluid composition 36 in this example will, thus, flow much more directly from the inlet 44 to the outlet 40.

It will be appreciated that the much more circuitous flow path taken by the fluid composition 36 in the example of FIG. 4A dissipates more of the fluid composition's energy at the same flow rate and, thus, results in more resistance to flow, as compared to the much more direct flow path taken by the fluid composition in the example of FIG. 4B. If gas or steam is a desired fluid, and water and/or oil are undesired fluids, then it will be appreciated that the variable flow resistance system 25 of FIGS. 4A & B will provide less resistance to flow of the fluid composition 36 when it has an increased ratio of desired to undesired fluid therein, and will provide greater resistance to flow when the fluid composition has a decreased ratio of desired to undesired fluid therein.

Figure 5:
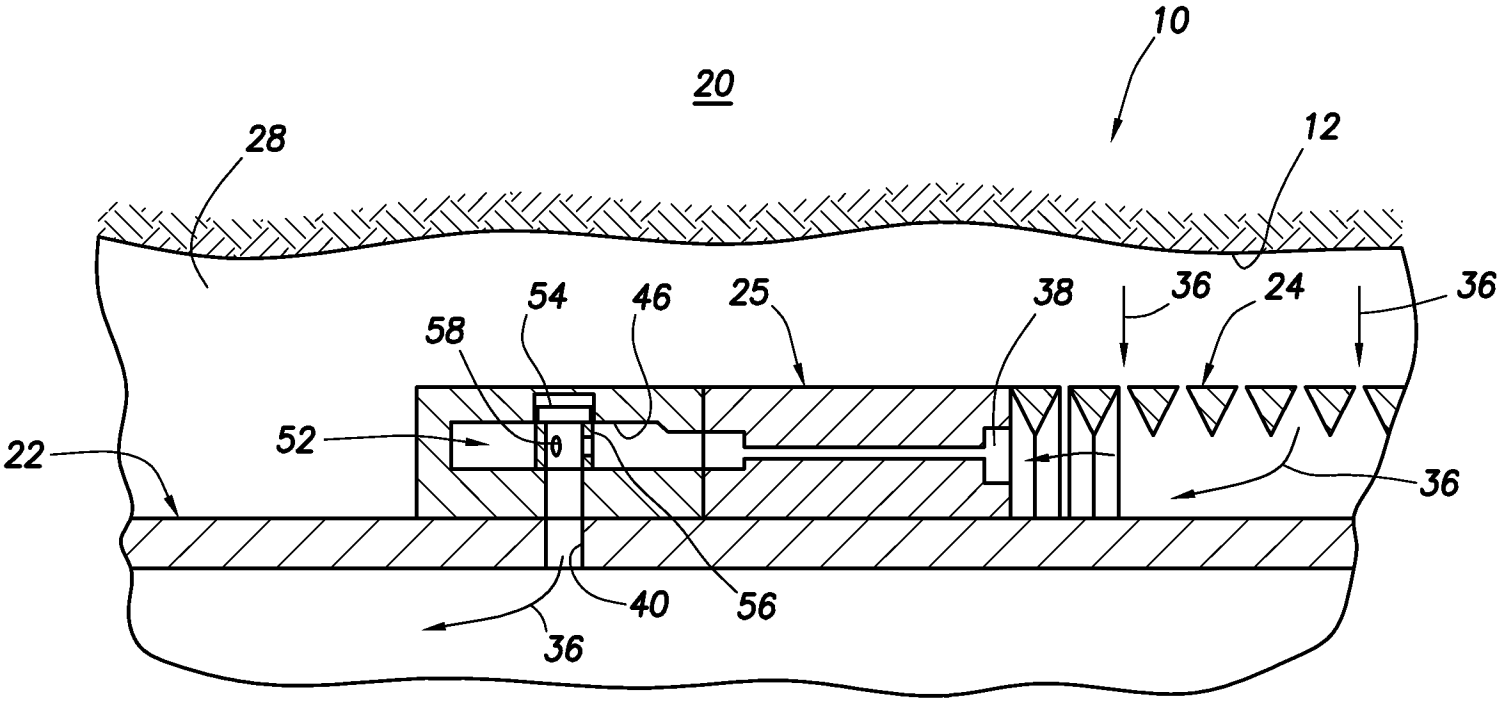
FIG. 5 is a representative cross-sectional view of a well screen and a flow control system which may be used in the well system of FIG. 1.

Referring additionally now to FIG. 5, another configuration is representatively illustrated in which a flow control system 52 is used with the variable flow resistance system 25. The control system 52 includes certain elements of the variable flow resistance system 25 (such as, the flow chamber 46, outlet 40, etc.), along with a closure device 54 and a structure 56, to prevent flow into the tubular string 22 when an unacceptable level of undesired fluid has been flowed through the system.

The structure 56 supports the closure device 54 away from the outlet 40, until sufficient undesired fluid has been flowed through the chamber 46 to degrade the structure. In additional examples described below, the structure 56 resists a biasing force applied to the closure device 54, with the biasing force biasing the closure device toward the outlet 40.

The closure device 54 depicted in FIG. 5 has a cylindrical shape, and is somewhat larger in diameter than the outlet 40, so that when the closure device is released, it will cover and prevent flow through the outlet. However, other types of closure devices (e.g., flappers, etc.) may be used in keeping with the scope of this disclosure.

The closure device 54 may be provided with a seal or sealing surface for sealingly engaging a sealing surface (e.g., a seat) about the outlet 40. Any manner of sealing with the closure device 54 may be used, in keeping with the scope of this disclosure.

The structure 56 may be made of a material which relatively quickly corrodes when contacted by a particular undesired fluid (for example, the structure could be made of cobalt, which corrodes when in contact with salt water). The structure 56 may be made of a material which relatively quickly erodes when a high velocity fluid impinges on the material (for example, the structure could be made of aluminum, etc.). However, it should be understood that any material may be used for the structure 56 in keeping with the principles of this disclosure.

The structure 56 can degrade (e.g., erode, corrode, break, dissolve, disintegrate, etc.) more rapidly when the fluid composition 36 flows circuitously through the chamber 46. Thus, the structure 56 could degrade more rapidly in the relatively high velocity and/or low viscosity situation depicted in FIG. 3A, or in the relatively high viscosity and/or low velocity situation depicted in FIG. 4A.

However, note that the chamber 46 is not necessarily a "vortex" chamber. In some examples, the structure 56 can release the closure device 54 for displacement to its closed position when a particular undesired fluid is flowed through the chamber 46, when an increased ratio of undesired to desired fluids is in the fluid composition 36, etc., whether or not the fluid composition 36 flows circuitously through the chamber.

Note that, as depicted in FIG. 5, the structure 56 encircles the outlet 40, and the fluid composition 36 flows through the structure to the outlet. Openings 58 in the wall of the generally tubular structure 56 are provided for this purpose. In other examples, the fluid composition 36 may not flow through the structure 56, or the fluid composition may flow otherwise through the structure (e.g., via grooves or slots in the structure, the structure could be porous, etc.).

Figure 6:
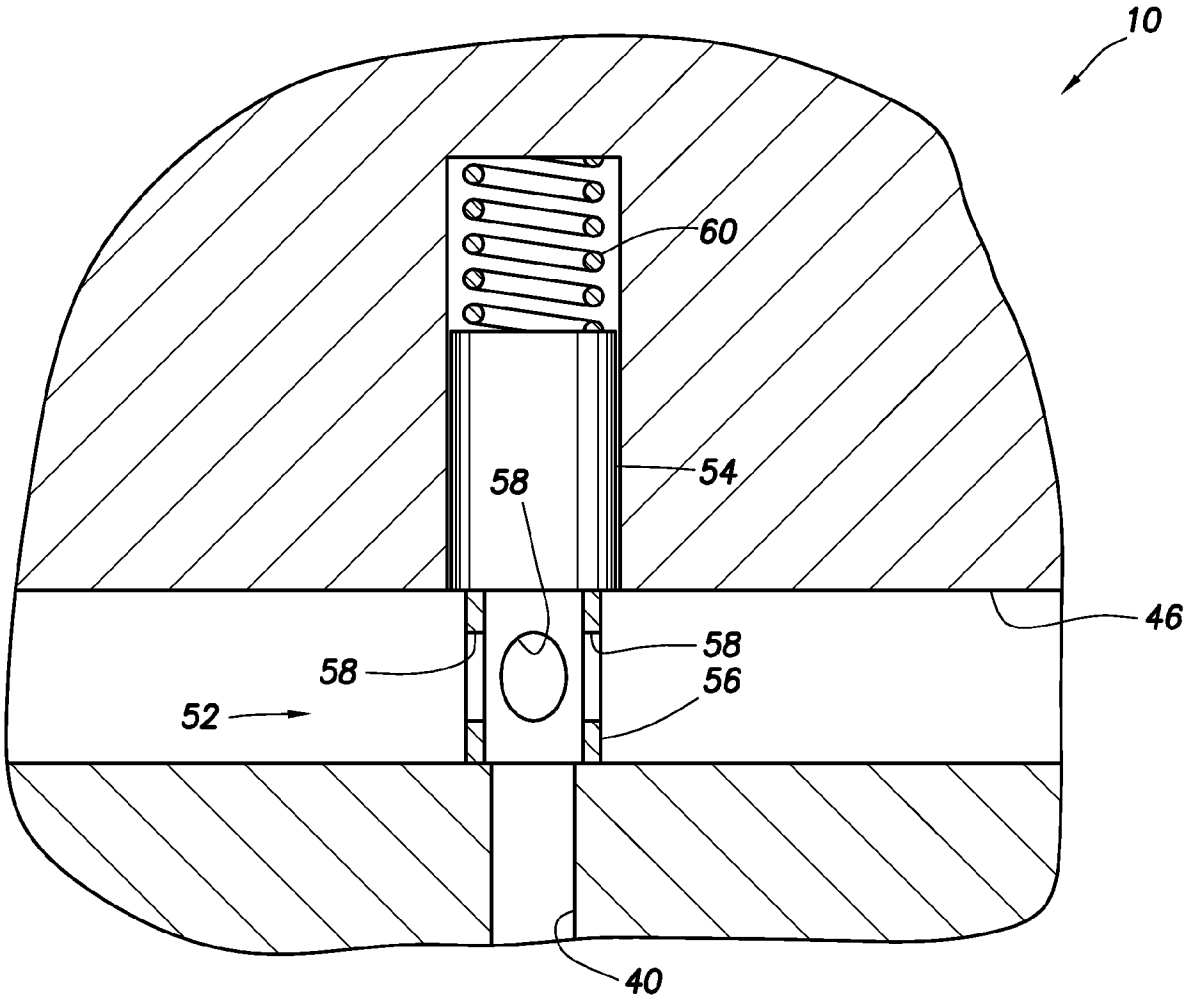
FIG. 6 is a representative cross-sectional view of another example of the flow control system.

Referring additionally now to FIG. 6, another example of the flow control device 52 is representatively illustrated at an enlarged scale. In this example, a biasing device 60 (such as a coil spring, Belleville washers, shape memory element, etc.) biases the closure device 54 toward its closed position.

The structure 56 is interposed between the closure device 54 and a wall of the chamber 46, thereby preventing the closure device from displacing to its closed position. However, when the structure 56 is sufficiently degraded (e.g., in response to a ratio of undesired to desired fluids being sufficiently large, in response to a sufficient volume of undesired fluid being flowed through the system, etc.), the structure will no longer be able to resist the biasing force exerted by the biasing device, and the closure device 54 will be permitted to displace to its closed position, thereby preventing flow through the chamber 46.

Figure 7:
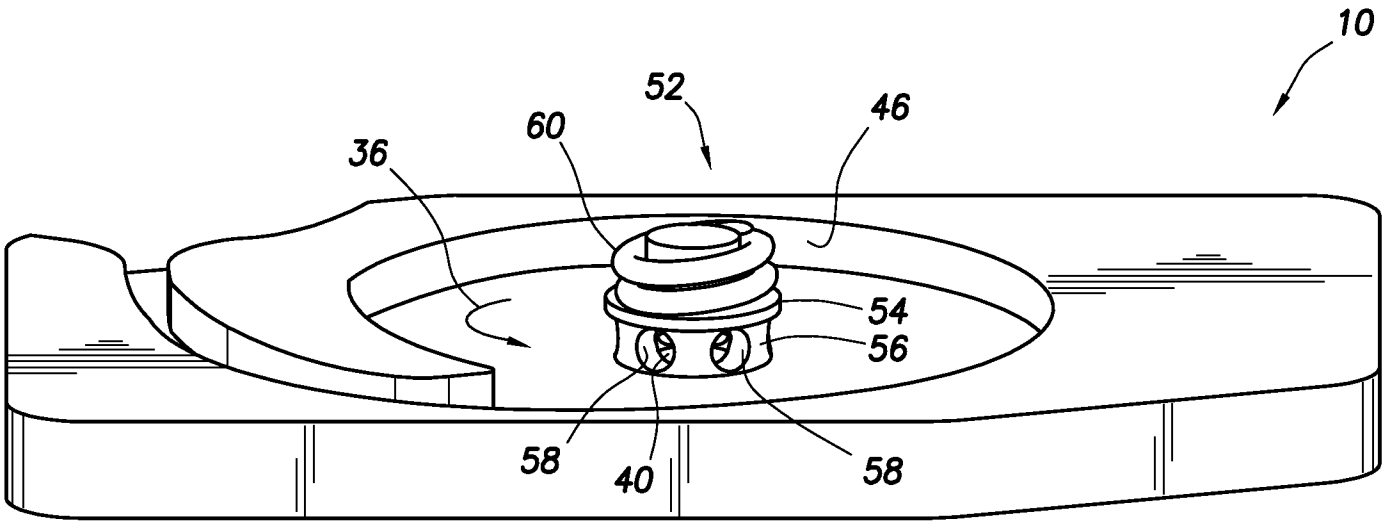
FIG. 7 is a representative perspective view of another example of the flow control system.

Referring additionally now to FIG. 7, another example of the flow control system 52 is representatively illustrated in perspective view, with an upper wall of the chamber 46 removed for viewing the interior of the chamber. In this example, the biasing device 60 encircles an upper portion of the closure device 54.

The structure 56 prevents the closure device 54 from displacing to its closed position. The biasing device 60 exerts a biasing force on the closure device 54, biasing the closure device toward the closed position, but the biasing force is resisted by the structure 56, until the structure is sufficiently degraded.

Although in the examples depicted in FIGS. 3A-7, only a single inlet 44 is used for admitting the fluid composition 36 into the chamber 46, in other examples multiple inlets could be provided, if desired. The fluid composition 36 could flow into the chamber 46 via multiple inlets 44 simultaneously or separately. For example, different inlets 44 could be used for when the fluid composition 36 has corresponding different characteristics (such as different velocities, viscosities, etc.).

Although various configurations of the variable flow resistance system 25 and flow control system 52 have been described above, with each configuration having certain features which are different from the other configurations, it should be clearly understood that those features are not mutually exclusive. Instead, any of the features of any of the configurations of the systems 25, 52 described above may be used with any of the other configurations.

It may now be fully appreciated that the above disclosure provides a number of advancements to the art of controlling fluid flow in a well. The flow control system 52 can operate automatically, without human intervention required, to shut off flow of a fluid composition 36 having relatively low viscosity, high velocity and/or a relatively low ratio of desired to undesired fluid. These advantages are obtained, even though the system 52 is relatively straightforward in design, easily and economically constructed, and robust in operation.

The above disclosure provides to the art a flow control system 52 for use with a subterranean well. In one example, the system 52 can include a flow chamber 46 through which a fluid composition 36 flows, and a closure device 54 which is biased toward a closed position in which the closure device 54 prevents flow through the flow chamber 46. The closure device 54 can be displaced to the closed position in response to an increase in a ratio of undesired fluid to desired fluid in the fluid composition 36.

A biasing device 60 may bias the closure device 54 toward the closed position.

The closure device 54 may displace automatically in response to the increase in the ratio of undesired to desired fluid.

The increase in the ratio of undesired to desired fluid may cause degradation of a structure 56 which resists displacement of the closure device 54.

The fluid composition 36 may flow through the structure 56 to an outlet 40 of the flow chamber 46.

The structure 56 may encircle an outlet 40 of the flow chamber 46.

The increase in the ratio of undesired to desired fluid may cause corrosion, erosion and/or breakage of the structure 56.

The closure device 56, when released, can prevent flow to an outlet 40 of the flow chamber 46.

The increase in the ratio of undesired to desired fluid in the fluid composition 36 may result from an increase in water or gas in the fluid composition 36.

The increase in the ratio of undesired to desired fluid in the fluid composition 36 may result in an increase in a velocity of the fluid composition 36 in the flow chamber 46.

Also described above is a flow control system 52 example in which a structure 56 prevents a closure device 54 from being displaced to a closed position in which the closure device 54 prevents flow of a fluid composition 36 through a flow chamber 46, and in which the fluid composition 36 flows through the structure 56 to an outlet 40 of the flow chamber 46.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A flow control system for use with a subterranean well, the system comprising:

a vortex chamber through which a fluid composition flows; and a closure device which is biased toward a closed position in which the closure device prevents flow through the vortex chamber, the closure device being displaced to the closed position in response to an increase in a ratio of undesired fluid to desired fluid in the fluid composition, wherein the increase in the ratio of undesired to desired fluid causes degradation of a structure which resists displacement of the closure device, and wherein the fluid composition flows across the structure to an outlet of the vortex chamber.

2. The system of claim 1, wherein the fluid composition flows through at least one opening in a side wall of the structure.

3. The system of claim 1, wherein the degradation of the structure results from an increase in a velocity of the fluid composition in the vortex chamber.

4. The system of claim 1, wherein the increase in the ratio of undesired to desired fluid causes corrosion of the structure.

5. The system of claim 1, wherein the increase in the ratio of undesired to desired fluid causes erosion of the structure.

6. A flow control system for use with a subterranean well, the system comprising:

a vortex chamber through which a fluid composition flows, wherein the fluid composition spirals about an outlet of the vortex chamber;

a closure device which is biased toward a closed position in which the closure device prevents flow through the outlet of the vortex chamber; and a structure which initially prevents the closure device from displacing to the closed position, wherein the closure device is displaced to the closed position in response to an increase in a ratio of undesired fluid to desired fluid in the fluid composition.

7. A flow control system for use in a subterranean well, the system comprising:

a flow chamber through which a fluid composition flows;

a closure device; and a structure which prevents the closure device from being displaced to a closed position in which the closure device prevents flow through the flow chamber, wherein the fluid composition flows through openings in a sidewall of the structure to an outlet of the flow chamber, and wherein the closure device displaces to the closed position in response to degradation of the structure by the fluid composition.

8. The system of claim 7, wherein the degradation of the structure is caused by an increase in a ratio of undesired fluid to desired fluid in the fluid composition.

9. The system of claim 7, wherein the closure device is released automatically in response to the degradation of the structure.

10. The system of claim 8, wherein the structure is degraded by erosion of the structure.

11. The system of claim 8, wherein the structure is degraded by corrosion of the structure.

12. The system of claim 8, wherein the structure is degraded by breakage of the structure.

13. The system of claim 7, further comprising a biasing device which biases the closure device toward the closed position.

14. The system of claim 7, wherein the degradation of the structure results from an increase in water in the fluid composition.

15. The system of claim 7, wherein the degradation of the structure results from an increase in a velocity of the fluid composition in the flow chamber.

16. The system of claim 7, wherein the degradation of the structure results from an increase in gas in the fluid composition.

17. The system of claim 7, wherein the structure encircles the outlet.

* * * * *

UNITED STATES PATENT AND TRADEMARK OFFICE

CERTIFICATE OF CORRECTION

PATENT NO. : 8,684,094 B2
APPLICATION NO. : 13/659435
DATED : April 1, 2014
INVENTOR(S) : Stephen M. Greci It is certified that error appears in the above-identified patent and that said Letters Patent is hereby corrected as shown below:

Title page, insert item (30), "Foreign Application Priority Data"
-- 14 November 2011 (WO) ..... PCT/US11/60606 --.

Signed and Sealed this
Twenty-fourth Day of June, 2014

Michelle K. Lee

Michelle K. Lee
*Deputy Director of the United States Patent and Trademark Office*